US009788646B2

(12) United States Patent
Halde

(10) Patent No.: US 9,788,646 B2
(45) Date of Patent: Oct. 17, 2017

(54) COUPLING ARRANGEMENT AND FURNITURE PIECE

(71) Applicant: Benjamin Halde, München (DE)

(72) Inventor: Benjamin Halde, München (DE)

( * ) Notice: Subject to any disclaimer, the term of this patent is extended or adjusted under 35 U.S.C. 154(b) by 336 days.

(21) Appl. No.: 14/373,896

(22) PCT Filed: Jan. 22, 2013

(86) PCT No.: PCT/EP2013/000187

§ 371 (c)(1),
(2) Date: Jul. 22, 2014

(87) PCT Pub. No.: WO2013/107658

PCT Pub. Date: Jul. 25, 2013

(65) Prior Publication Data

US 2014/0341638 A1 Nov. 20, 2014

(30) Foreign Application Priority Data

Jan. 22, 2012 (DE) ..... 10 2012 200 861

(51) Int. Cl.
*A47B 46/00* (2006.01)
*A47B 17/03* (2006.01)
(Continued)

(52) U.S. Cl.
CPC ..... *A47B 17/036* (2013.01); *A47B 17/03* (2013.01); *A47B 17/065* (2013.01); *A47C 7/70* (2013.01); *Y10T 403/32057* (2015.01)

(58) Field of Classification Search
CPC ..... A47B 21/00; A47B 21/02; A47B 21/03; A47B 17/03; A47B 17/036; A47B 17/06;
(Continued)

(56) References Cited

U.S. PATENT DOCUMENTS 278,152 A 5/1883 Larson
330,409 A 11/1885 Larson
(Continued)

FOREIGN PATENT DOCUMENTS

DE DD 60865 11/1966
DE 7038105 10/1970
(Continued)

*Primary Examiner* — Michael P Ferguson
(74) *Attorney, Agent, or Firm* — Maschoff Brennan

(57) ABSTRACT

A coupling arrangement for two panels (12, 13) that are movable relative to one another may include comprises a first and a second guide track; (1, 2) and a first and a second guide pin (5, 6) for engaging in the guide tracks (1, 2). The first guide track describes a straight path having a starting point and an end point. (E1), and the The second guide track describes a first straight section which is arranged parallel to the first guide track, a circle section and a second straight section which extends parallel to the first guide track. In the case of a piece of furniture having a first panel and a second panel, the panels are coupled together with the aid of a coupling arrangement such that, from a starting position of the panels (12, 13), a guided translation (T1, T2) and a guided rotation of the panels (12, 13) with respect to one another can take place in succession.

13 Claims, 8 Drawing Sheets

(51) Int. Cl.
*A47B 17/06* (2006.01)
*A47C 7/70* (2006.01)

(58) Field of Classification Search
CPC ..... A47B 17/065; A47B 5/006; A47B 46/00; A47B 63/04; Y10T 403/32959; Y10T 403/32967; Y10T 403/32245; Y10T 403/32073; Y10T 403/32057; Y10T 403/32581; Y10T 403/32951
See application file for complete search history.

(56) References Cited

U.S. PATENT DOCUMENTS 332,360 A * 12/1885 Penney ..... A47B 88/06 108/140
379,232 A 3/1888 Larson
478,594 A * 7/1892 Hafgar ..... A47B 46/00 296/16
535,886 A * 3/1895 Brand ..... F04D 25/08 296/16
556,707 A 3/1896 Strahan
1,406,129 A 2/1922 Woltz
1,985,189 A 12/1934 Moore
2,202,277 A * 5/1940 Visser ..... B60K 37/02 180/90
2,613,726 A 10/1952 Paatero
2,650,871 A * 9/1953 Holderegger ..... A47B 88/06 16/374
4,124,262 A * 11/1978 Schill ..... A47B 49/004 16/378
4,392,628 A * 7/1983 Hadfield ..... A47B 49/004 211/144
5,460,105 A * 10/1995 Given, Jr. ..... A47B 17/03 108/137
6,422,668 B1 7/2002 Kelley et al.
6,481,586 B1 * 11/2002 Hoff ..... A47B 49/00 211/90.02

FOREIGN PATENT DOCUMENTS

DE 1654503 2/1971
DE 2349792 4/1975
DE 202008014973 2/2009
DE 20 2010 012 749 1/2011

* cited by examiner (C-C)

(a)

(b)

COUPLING ARRANGEMENT AND FURNITURE PIECE

FIELD OF THE INVENTION

The present invention relates to a coupling arrangement for coupling two panels together, for example for use in table tops that are displaceable and/or rotatable with respect to one another. Furthermore, a piece of furniture is proposed.

BACKGROUND

In particular in furniture construction, in the case of flexibly configurable pieces of furniture there is a need to carry out rotations and displacements of panels or part bodies of pieces of furniture. Rotations are in this case frequently executed via hinge mechanisms and displacements with the aid of fitted guide rails in combination with casters. In the past, use was also made of complicated articulation mechanisms which allowed simultaneous displacement and rotation of furniture parts with respect to one another.

Under specific space conditions, for example in the case of pieces of furniture located in corners, rotations and displacements are rendered difficult spatially. Moreover, it is frequently necessary to displace heavy table tops with respect to one another, this requiring a particularly robust mechanism. U.S. Ser. No. 556,707 discloses a desk in which a smaller desk top leads to a widening or enlargement of the supporting surface via two guide pins which are displaced in guide channels. The additional small desk top is then secured laterally.

However, it is frequently necessary to couple heavy panels together and displace them. For example, the possibility of both guiding movable panels and securely connecting them together is desirable.

SUMMARY

Against this background, it is the object of the present invention to create improved coupling possibilities.

Accordingly, a coupling arrangement for two panels that are movable relative to one another is proposed, having a first and a second guide track and a first and a second guide pin for engaging in the guide tracks. In this case, the first guide track describes a straight path section having a starting point and an end point. In particular when the panels are in a coupling position with respect to one another, the second guide track describes a first straight section which is arranged parallel to the first guide track, a circle section and a second straight section which extends parallel to the first guide track.

The arrangement of the guide tracks with respect to one another allows sequentially a translation, rotation and translation again. As a result, the coupling arrangement can be used efficiently in pieces of furniture which are arranged for example in corners. In this case, the straight parts of the guide tracks can be arranged for example along the angle bisector of a room corner or table corner.

In one embodiment, the first guide track comprises only a straight path.

The coupling arrangement allows in particular either a translation or a rotation in a particular position of the panels. Rotation at the same time as displacement is preferably not possible on account of the geometry of the guide tracks.

The guide tracks can be embodied for example in the manner of grooves and the guide pins in the manner of sliding blocks. It is possible to provide the guide track in a first coupling panel and the guide pins on a second coupling panel, wherein the coupling panels are attached to, set into or integrated into the panels of a piece of furniture that are movable relative to one another.

In the proposed coupling arrangement, no articulations or hinges which make it difficult to produce coupling arrangements are used. Moreover, as a result of the combination of guide tracks with guide pins, a particularly robust arrangement which makes it possible to mount even heavy panels on one another is created. For example, the two movable panels can rest on one another and be guided by way of the coupling arrangement.

In this case, at least one guide track may have a guide groove having a plurality of steps. The steps create improved lateral support of the guide pins in the guide tracks.

It is conceivable for the guide tracks to be arranged in or on different coupling panels. For example, the first guide track is arranged in a first coupling panel and the second guide track is arranged in a second coupling panel.

In one embodiment of the coupling arrangement, at least one guide track has an undercut. Together with a correspondingly formed guide pin, the undercut allows particularly reliable guidance. In particular, for example a guide pin is formed such that the guide pin also holds the two coupling panels together in a state in which it is inserted into the guide track.

A guide pin can in particular comprise a spherical shape or have a flat cylinder which rests in the guide track by way of its flat side.

In this respect, the combination of suitable guide pins and guide tracks having an undercut results in secure fastening of panels that are movable with respect to one another. In the case of the configuration of the guide tracks having an undercut, the geometry of the guide track results in guidance of the panels with respect to one another only along the predefined trajectories in a plane. Guide pins are largely prevented from being removed from or falling out of the guide track.

In embodiments of the coupling arrangement, the first and/or the second guide track has an insertion recess for inserting a guide pin into the guide track. In this respect, widening or enlargement at a starting or end point of the particular guide track is conceivable. The sliding block or guide pin is then easily insertable at this insertion recess and can be pushed into the undercut. This results in particularly reliable guidance.

Furthermore, provision is preferably made of a closure element for inserting into the insertion recess and for closing the insertion recess. As a result, the guide pin is prevented from slipping out of the guide track. This results in secure coupling of movable panels together, wherein well-defined guidance both along the translation parameters provided by the geometry of the guide tracks and in rotation about for example the end point of the first guide track can take place.

In the coupling arrangement, it is possible for example for a circle center of the circle section for the second guide track to be located at the end point of the straight path of the first guide track. Preferably, the first and the second straight section of the second guide track extend at one and the same distance from the first guide track. For example, the radius of the circle section corresponds to the distance between the parallel straight sections. For example, in an embodiment of the circle section as a quarter-circle section, a defined rotation through 90° of panels that are movable with respect to one another results. However, rotations through other angular ranges are also conceivable. For example, the circle section of the second guide track may be configured such that a rotation through 180° is possible.

Preferably, the guide tracks do not intersect. Moreover, the guide tracks preferably do not have any bifurcations, i.e. do not branch. As a result, reliable guidance that is safeguarded against tilting and jamming can take place.

In further embodiments of the coupling arrangement, the first and the second guide track comprise only straight sections and arcuate sections. As a result of this simple configuration, reliable guidance is possible and virtually no tilting and jamming of the two guide pins in the guide tracks is possible.

The guide pins are in a fixed arrangement with respect to one another. The guide pins can for example be fastened securely to a coupling panel or a furniture panel.

In embodiments, the guide tracks are arranged for example in a coupling panel which is manufactured at least partially from a plastics material. Plastics material can be processed easily and so the guide tracks can be realized in particular by way of material removal. In embodiments, the guide tracks are milled into the coupling panel material in the manner of a groove.

For example, the coupling arrangement comprises a first coupling panel in which the guide tracks are arranged and a second coupling panel on which the guide pins are arranged.

In a further embodiment of the coupling arrangement, the first guide track and the second guide pin for engaging in the second guide track are arranged in or on a first coupling panel. The second guide track and the first guide pin for engaging in the first guide track are then arranged on a second coupling panel. This results in particularly secure coupling together of the coupling panels, which moreover allow particularly reliable guidance and rotation of the panels.

In embodiments of the coupling arrangement, a coupling panel has a first panel with a guide track passing through the first panel, and a second, closed panel which is arranged on the first panel and closes the guide track on one side. A two-part design makes manufacturing easier and an undercut for reliably receiving sliding blocks is producible at low cost.

Preferably, the coupling arrangement comprises exactly two guide tracks and exactly two guide pins. The guide pins can have for example circular profiles or be round or spherical with an attachment pin. Provision can also be made of a plurality of guide tracks and pins.

Embodiments of the coupling arrangement have at least three guide tracks and three guide pins, wherein the guide pins form in particular a triangle. The guide tracks are preferably at least sectionally parallel to one another.

A piece of furniture having a first panel and a second panel is furthermore proposed. The first and the second panel are coupled together with the aid of a coupling arrangement as described above. The coupling is in this case such that, from a starting position of the panels, a guided translation and a guided rotation of the panels with respect to one another can take place in succession.

For example, the two panels are initially congruent in a corner. Subsequently, a translation takes place along the two straight sections of the guide tracks which extend in particular parallel to the angle bisector of the corner. Subsequently a rotation takes place about the end point of the first guide track, wherein the rotation axis is located in the surface of the two panels. Depending on the configuration of the arcuate section, the rotation is fixed, for example at 90°. Subsequently, a guided translation back into the corner takes place, wherein the two panels have been rotated through 90° compared with the starting position.

In embodiments, the first and the second panel are arranged vertically for mutual pivoting. On account of the reliable guidance and coupling together of the guide pins and tracks, the coupling arrangement is also suitable for ensuring a reliable pivoting movement counter to gravity in a vertical installation situation.

The following come into question by way of example as the piece of furniture: a table, a piece of seating furniture, a rack or a cabinet. It is in particular possible to equip airplane or Pullman seats with the coupling arrangement in order to form a swiveling table. In a further embodiment, the coupling arrangement couples a footrest to a chair or seat, wherein two coupling arrangements are fastened vertically and the footrest extends between the two coupling arrangements.

Further possible implementations of the invention also comprise combinations that are not explicitly mentioned of the features or embodiments of the coupling arrangement that are described above or in the following text with regard to the exemplary embodiments. Here, a person skilled in the art will also add or modify individual aspects as improvements or additions to the particular basic form of the invention.

BRIEF DESCRIPTION OF THE DRAWINGS

Further advantageous configurations and aspects of the invention are the subject matter of the dependent claims and of the exemplary embodiments described in the following text. The invention is explained below by way of preferred embodiments with reference to the appended figures.

In the figures.

DETAILED DESCRIPTION

In the figures, identical or functionally identical elements are provided with the same reference signs, unless otherwise specified.

Figure 1:
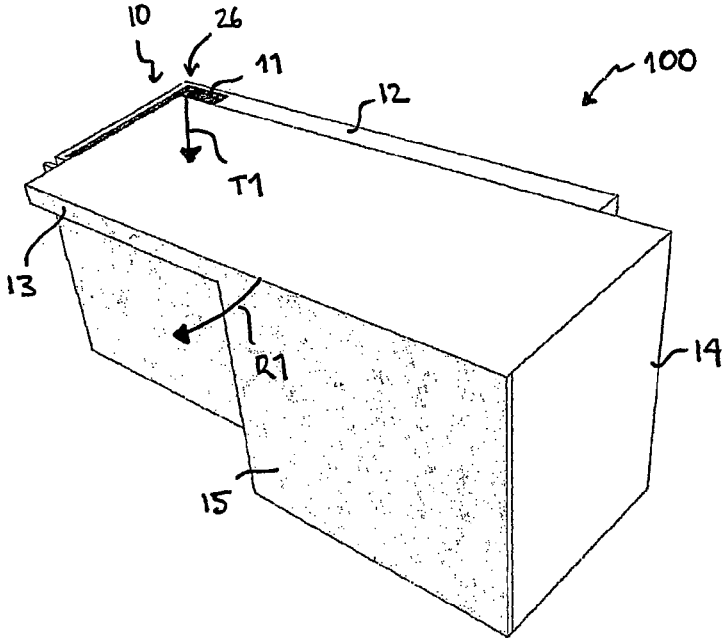
FIGS. 1-3: show perspective views of one embodiment of a piece of furniture.
Figure 2:
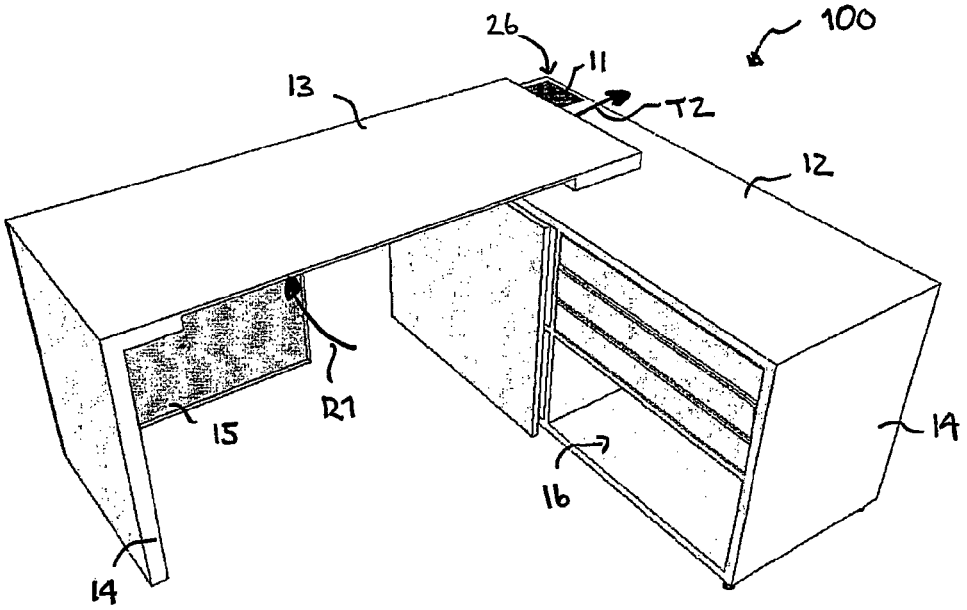
Figure 3:
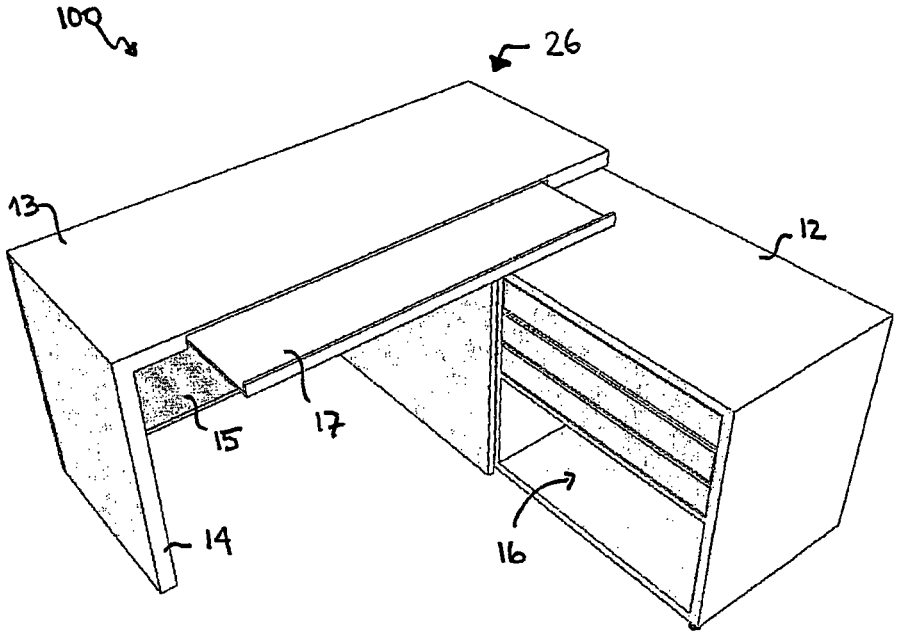

FIGS. 1 to 3 show perspective views of one embodiment of a piece of furniture which comprises two furniture panels that are coupled together and guided. The piece of furniture is illustrated in the manner of a corner piece of furniture as a desk. Here, two panels that rest on one another are intended to be rotated with respect to one another.

In this case, the piece of furniture 100 has in particular a first worktop 12 and a second worktop 13 that rests thereon and is part of an L-shaped table. In this case, the worktop 13 forms a first limb of the L and a perpendicular side support 14 forms the second limb of the L. In the illustration in FIG. 1, a screening wall 15 can also be seen at the front right. The two panels 12, 13 of the piece of furniture 100 are coupled together via a coupling arrangement 10. A coupling panel 11 integrated into the panel 12 can be seen at the corner 26 located at the rear left in the orientation of FIG. 1.

It is now in particular desired and possible, by way of the coupling arrangement 10 described below, first of all to execute a translation T1 along the angle bisector of the corner. This is indicated by the arrow T1. This is followed by a rotation R1 about a rotation axis which is located perpendicularly and in the surface of the panels 12 and 13. FIG. 2 shows the position in which the upper tabletop 13 has first of all been translated and has been positioned perpendicularly opposite the tabletop 12 through the rotation R1. Storage space 16 beneath the first panel 12 can furthermore be seen in the illustration in FIG. 2.

The first translation T1 is in this case guided such that, for the rotation of the panel 13, no overhang whatsoever of the panel 13 rearwardly to the corner 26 or the adjoining side with respect to the panel 12 is required. Subsequently, as is illustrated in FIG. 3, a further translation T2 is carried out. In the end state, the two panels 12, 13 have been rotated through 90° with respect to one another. The two corners 26 are located on top of one another again. Of course, the movement can be reversed again, or the panels 12, 13 reach intermediate positions.

It is possible to adapt the guided relative movement of the panels 12, 13 with respect to one another to the installation or position conditions of the particular piece of furniture. The guided displacement or translation and the pivot point or rotation axis result in particular also from the length of the straight sections 21, 23 in relation to the length of the straight path of the first guide track 1. For example, the second translation T2 can be reduced by shortening the section 23 with respect to the length of the section 21. Furthermore, for example by forming a semicircle arc of the circle section 22, rotatability of the panels 12, 13 through 180° with respect to one another could be specified. The coupling arrangement 10 allows flexible configurations.

Figure 4:
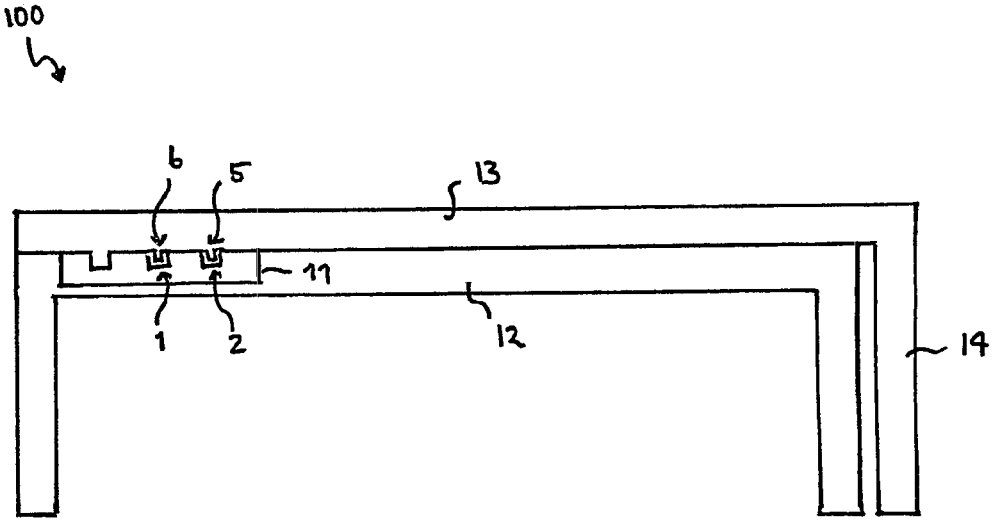
FIG. 4: shows a schematic sectional view of the embodiment of a piece of furniture.

FIG. 3 furthermore shows a pullout 17 as a storage shelf in the visible side of the L-shaped piece made of the limbs 13 and 14. The inserted coupling arrangement 10 can be seen in FIG. 4 in a schematic cross-sectional view of the piece of furniture 100. The lower furniture part having the panel 12 can be seen. Arranged thereon is the L-shaped piece having the horizontal tabletop 13 and the side support panel 14. Incorporated into the panel 12 is a coupling panel 11. In this case, the coupling panel 11 comprises two guide grooves or guide tracks 1, 2 which are illustrated schematically in the sectional view in FIG. 4. Guide pins 5, 6 which are arranged on the underside of the panel 13 engage in the guide tracks 1, 2. The guide pins are guided for example in the manner of sliding blocks in the groove-like guide tracks 1, 2.

Figure 5:
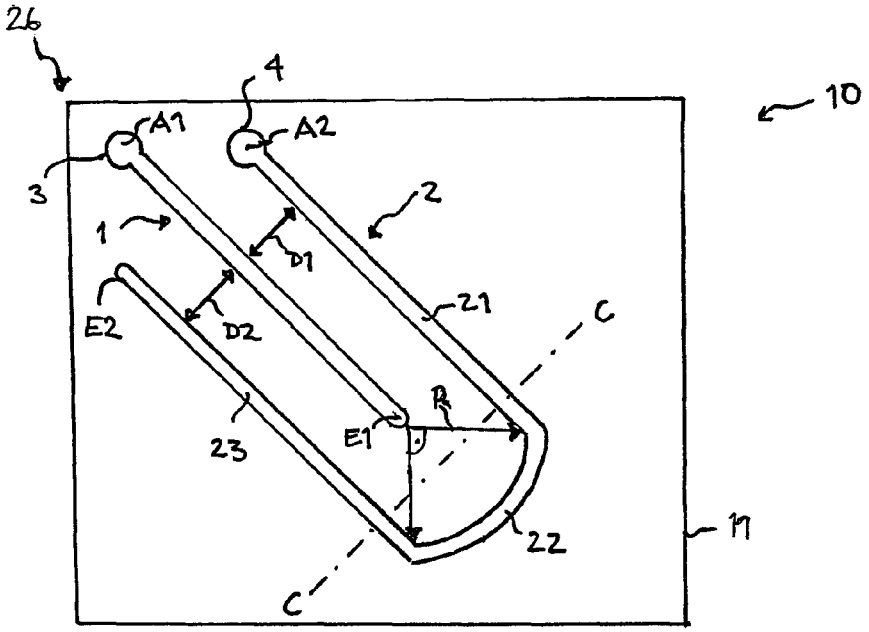
FIG. 5: shows a plan view of one embodiment of a coupling arrangement.
Figure 6:
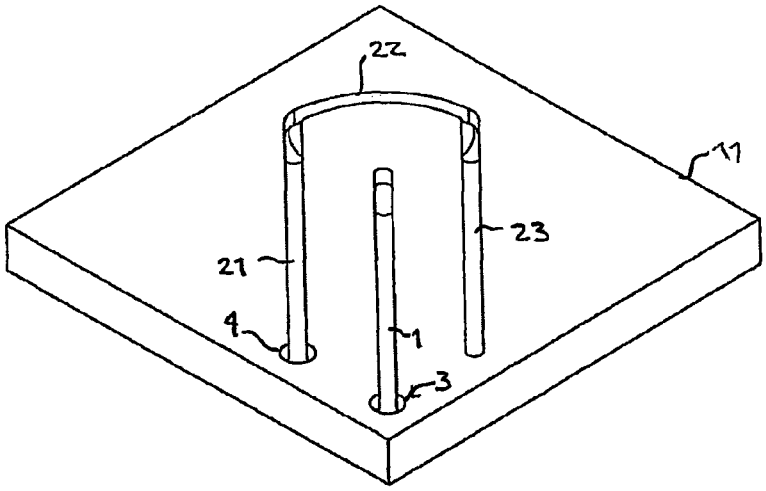
FIG. 6: shows a perspective view of the embodiment of a coupling arrangement.
Figure 7:
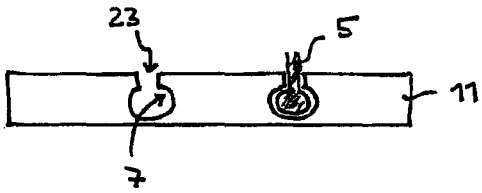
FIG. 7: shows a schematic sectional view of the embodiment of a coupling arrangement.

In order to explain the guidance of the translation and rotation better, plan views, perspective views and sectional illustrations of the coupling arrangement 10 are illustrated schematically in FIGS. 5 to 7. In this case primarily the lower coupling panel 11 is explained. The coupling panel 11 is produced for example from plastics material and has milled guide tracks 1, 2. The panel is arranged with the upper left-hand corner 26 in the direction of the corner 26 with respect to the orientation of FIGS. 1 to 3.

This results in a first guide track 1 which describes a straight path from a starting point A1 to an end point E1. The straight path of the guide track 1 forms for example or, when installed in a piece of furniture, as is indicated in FIGS. 1-3, is arranged parallel to an angle bisector for the corner 26.

The coupling panel 11 has a second guide track 2 which, in the embodiment in FIGS. 5 to 7, comprises three sections 21, 22, 23 which transition into one another. The second guide track 2 has a starting point A2 from which a straight path section 21 starts. The path section 21 is parallel to the first guide track 1. The first straight section 21 is followed by a circle section 22. The circle section is in this case a quarter circle having the radius R. The circle section has its midpoint at the end point E1 of the first guide track 1. Finally, the second guide track 2 has a second straight section 23 which is again located parallel to the first guide track 1. Both guide tracks 1, 2 have an insertion opening 3, 4 for the guide pins (not illustrated here), which are arranged for example on a second coupling panel. The two straight sections 21, 23 of the second guide track 2 are at a distance D1 and D2, respectively, from the first guide track 1. The distances D1 and D2 are the same.

In the sectional illustration in FIG. 7, it can be seen that the guide tracks in the material of the coupling panel 11 each have an undercut 7. The undercut 7 prevents a sliding block or guide pin, as is illustrated as 5 in FIG. 7, from being able to slip out upwardly perpendicularly to the coupling panel. In this respect, guidance of the guide pins 5 only along the trajectory which is provided by the guide tracks 1, 2 takes place.

During displacement, as is illustrated in FIGS. 1 to 3, the two guide pins are present initially at the starting points A1 and A2. During the translation T1, the guide pins are guided in a fixed manner with respect to one another in the guide track 1 and the straight section 21. The guide pin in the first guide track remains in a fixed position at the end point E1 during the rotation R1. During the rotation R1, the second guide pin in the guide track 2 runs along the circle section 22. Subsequently, the first guide pin in the first guide track 1 is displaced from E1 to A1, while at the same time the second guide pin in the guide track 2 is guided along the straight path 23 to the end point E2. Of course, reverse guidance or movement is possible. This results in a well-defined manner in a combination of translation and rotation and additionally secure coupling on account of the undercuts in the guide tracks. In order to insert the sliding blocks or guide pins into the guide tracks, the insertion openings 3 and 4 are provided in a widened or enlarged manner.

Figure 8:
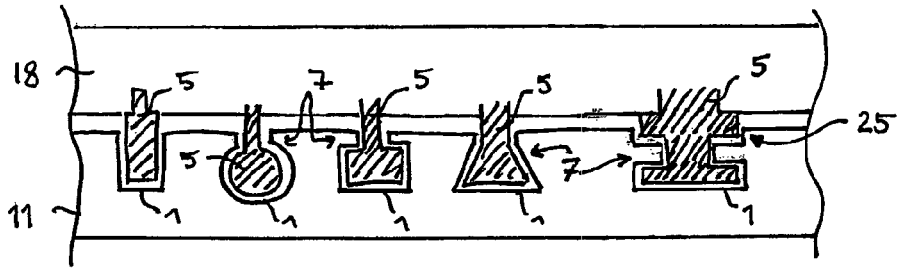
FIG. 8: shows schematic sectional views of embodiments of guide tracks and guide pins for a coupling arrangement.

FIG. 8 shows possible embodiments of guide tracks and guide pins for coupling arrangements in cross section. A lower coupling panel 11 and an upper coupling panel 18 can be seen in FIG. 8. The coupling panels 11, 18 can also in particular be part of a piece of furniture or be integrated into panels, for example worktops. Various cross-sectional geometries of guide tracks can be seen from left to right. A groove without an undercut, a circular groove, a rectangular groove, trapezoidal groove and a step-like groove are illustrated from left to right. In this case, the undercuts are each indicated by way of arrows 7. Sliding blocks or guide pins 5 are insertable or engageable along the longitudinal extent of the groove or guide track which extends perpendicularly to the plane of the page. In this case, the guide pins are adapted to the geometry of the guide track. In particular, plastics materials are suitable for the guide tracks and metal pins are suitable as guide pins.

The right-hand groove geometry comprises a groove sunk along the guide track 1. A channel is defined by edges 25 in the top surface of the lower coupling panel 11 can be seen. As a result, improved guidance is achieved. The guide pin used has in this case a lower section which is guided in the undercut 7 and an upper section which is guided in the (open) channel provided in the panel 11. The lower and upper sections are connected by a rod, wherein the upper and lower sections have a larger cross section than the rod along the rod axis. The corresponding guide pin 5 can be produced for example in one piece and may be turned from a metal.

Figure 9:
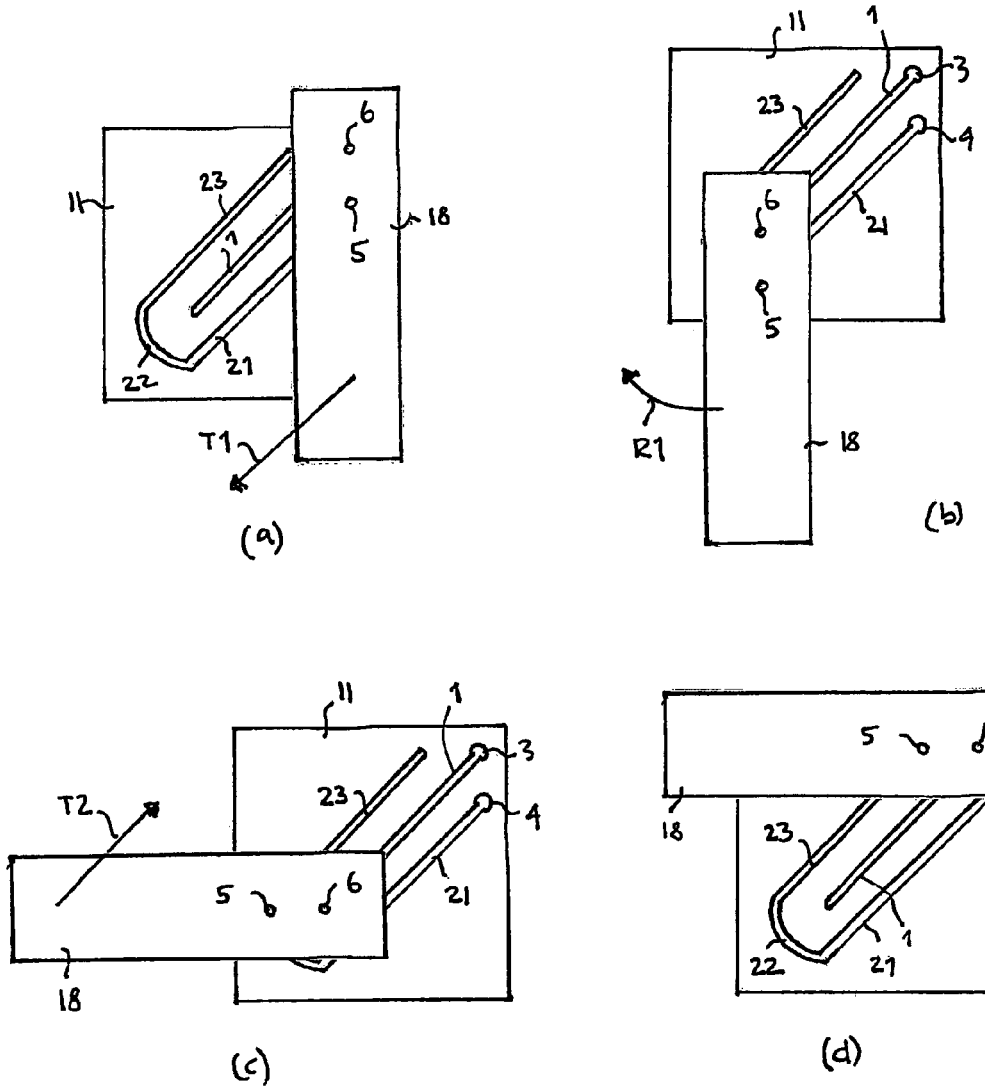
FIG. 9: shows schematic plan views of a two-part embodiment of a coupling arrangement for explaining the guided movement sequences.

FIG. 9 shows once again the relative movement of the guide pins and guide tracks with respect to one another, wherein the coupling arrangement, as explained with respect to FIGS. 1-6, comprises two coupling panels 11, 18. The guide tracks 1, 21, 22, 23 are provided in the first coupling panel 11, as illustrated in more detail also in FIGS. 5 and 6, and the guide pins 5, 6 are fastened to a second coupling panel 18. The coupling panels 11, 18 are fastened for example to panels of pieces of furniture with the aid of adhesive bonding, screw connection or the like. In this case, FIGS. 9*a* to 9*c* show the guided movements in translation T1 and T2 and the rotation R of the upper (second) coupling panel 18 with respect to the lower (first) coupling panel 11. FIG. 9*d* shows the end position according to FIG. 3 of the piece of furniture equipped with a corresponding coupling arrangement.

Figure 10:
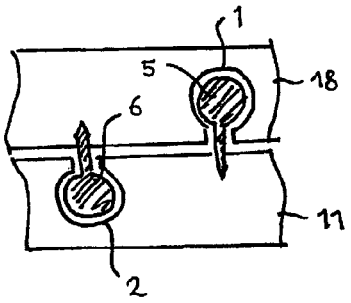
FIG. 10: shows a schematic sectional view of an embodiment of guide tracks and guide pins in different coupling panels.

FIG. 10 shows a sectional view of a further embodiment of guide tracks and pins. In order to improve the coupling together of the coupling panels 11, 18, for example the first guide track 1 is produced in the upper coupling panel 18 and the second guide track 2 is produced in the lower coupling panel 11. Furthermore, the first guide pin 5 is provided on the first coupling panel 11 and the second guide pin 6 is provided on the second coupling panel 18.

Figure 11:
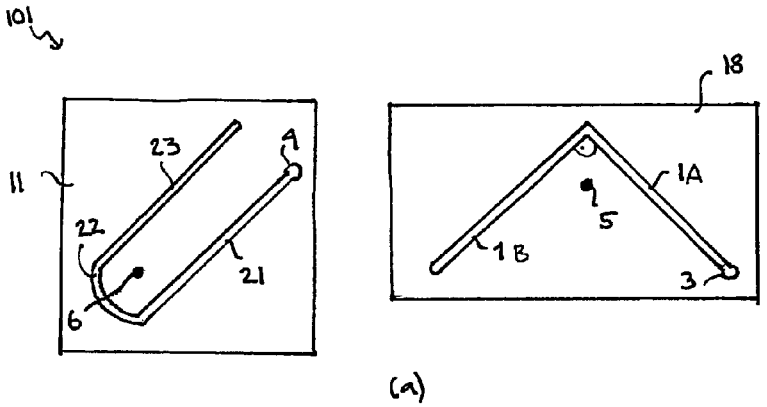
FIG. 11: shows a schematic plan view of a two-part embodiment of a coupling arrangement having guide tracks and guide pins in different coupling panels.
Figure 11:
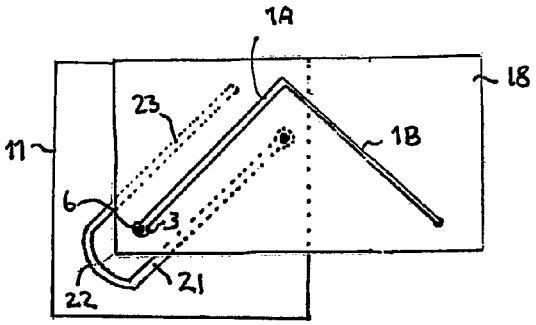

FIG. 11 shows an embodiment of a coupling arrangement 101 having two coupling panels 11, 18. Incorporated into the first coupling panel 11, which is illustrated on the left, is a guide track 21, 22, 23 which comprises two straight sections 21, 23 and an arcuate section 22 connecting the two parallel straight sections 21, 23. A guide pin 6 is arranged in a projecting manner on the panel 11 at the midpoint of the quarter-circle arc 22, and an insertion opening or recess 4 is provided on the guide track section 21. The second coupling panel 18, which is illustrated on the right, comprises a guide track which is composed of two straight sections 1A, 1B that form a right angle, and a guide pin 5 for engaging in the first guide track 21, 22, 23. An insertion recess 3 for the guide pin 6 of the other coupling panel is provided at one end of the guide track 1A. Since the guide tracks 1A, 1B and 21, 22, 23 are provided in different coupling panels 11, 18, the course that differs from the trajectories of the guide tracks, shown in FIGS. 5, 6 and 9, in one coupling panel results. FIG. 11*a* shows the two coupling panels 11, 18 alongside one another with a view of the guide tracks, and FIG. 11*b* is an illustration similar to FIG. 9, wherein the partially concealed lower panel elements are indicated by dotted lines.

Figure 12:
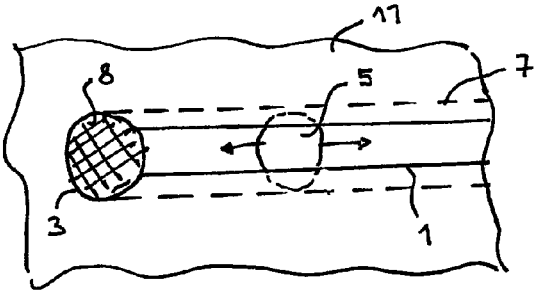
FIG. 12: shows a schematic plan view of one embodiment of a guide track.

Finally, FIG. 12 shows a detail of a guide track 1 in plan view. The guide track 1 has been milled into a coupling panel 11. The dashed lines indicate the undercut 7. The schematically indicated sliding block or guide pin 5 can be displaced only along the arrows in the longitudinal direction of the guide track 1 since it is retained by the undercut 7. The insertion opening 3, which has a sufficiently large cross section for the guide pin to be able to be inserted into the guide track 1 or guide grooves, can be seen on the left. Subsequently, the insertion opening, which is for example a blind hole, is closed. To this end, provision is made of a plug or screw 8 which acts as a closure element. Once the two elements of guide track and guide pins have been placed in one another and the insertion openings have been closed with for example a plug 8, secure and reliable coupling and fastening of the two parts with respect to one another results.

Figure 13:
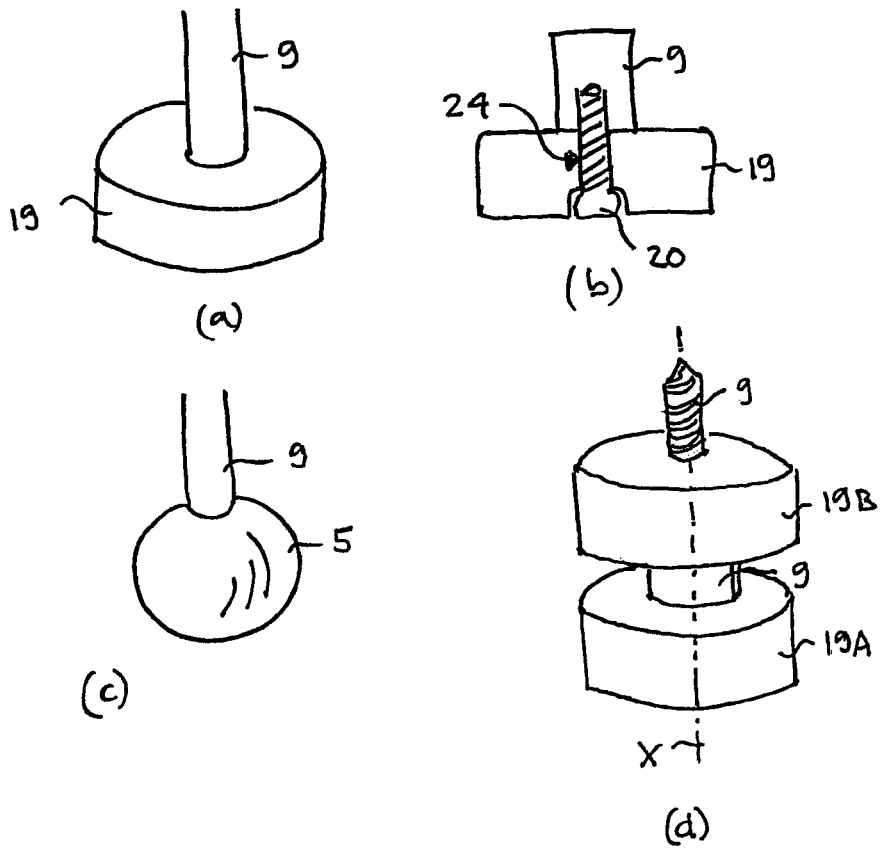
FIG. 13: shows schematic views of embodiments of guide pins.

FIG. 13 shows yet further embodiments of guide pins. FIG. 13*a* shows a perspective view of a guide pin having a lower section in the manner of a flat cylinder 19 which is provided with a shank or pin attachment 9. As a result of the rounding, the guide pin can slide well in a groove. FIG. 13*b* shows a modification or extension of the guide pin in a multipart embodiment. The flat cylinder 20 has an axial opening 24 through which a screw 20 engages. The screw 19 is screwed into the shank 9 and allows for example the cylinder to rotate in the manner of a wheel during the displacement and/or rotation operations in the particular guide track. FIG. 13*c* illustrates a further embodiment of a guide pin. In this case, a spherical body 5 is provided with a shank 9. The spherical form allows particularly good guidance within guide tracks. FIG. 13*d* shows a guide pin which is suitable in particular for a guide track cross section that is illustrated on the right in FIG. 8. The guide pin has, along an axis X, an upper and a lower flat cylinder section 19B, 19A, which are connected by a shank 9. The shank 9 is provided at least partially with a thread for example for screwing into a coupling panel. In the orientation of FIG. 13, the underside of the upper section 19*b* rests in a flat channel or groove in the surface of the corresponding opposite coupling panel.

Figure 14:
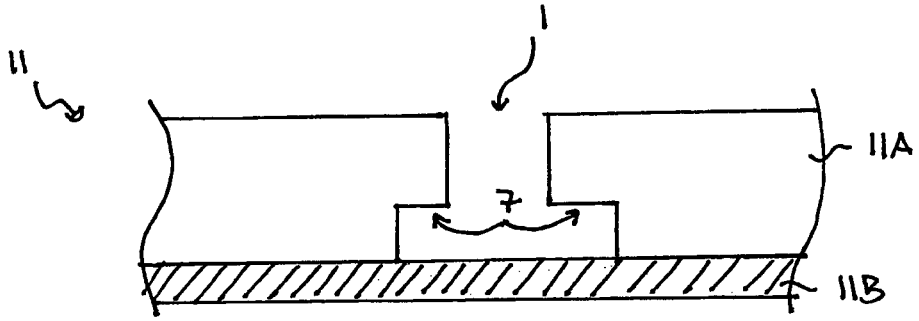
FIG. 14: shows a schematic sectional view of an alternative embodiment of a coupling panel.

FIG. 14 shows a further possible configuration of a coupling panel in cross section. The coupling panel 11 is constructed from two panels, wherein, in order to form the guide track 1 with an undercut 7, a first panel 11A is interrupted along the contour of the guide track and a second panel 11B for closing the apertures is fastened to the first panel. An insertion opening for a sliding block or guide pin is not necessary in this variant, since, when assembling the coupling arrangement, first of all the first panel 11A can be fitted to the piece of furniture, and then the guide pins are fastened to the second coupling panel or furniture panel (not shown here) and only in the final production step is the closed panel 11B fastened and closes the open grooves.

Figure 15:
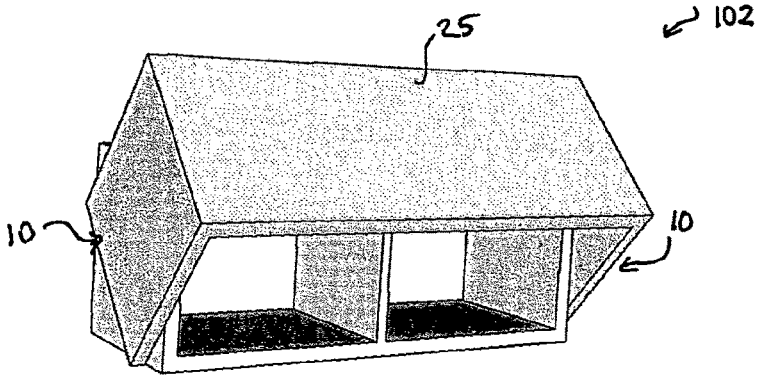
FIGS. 15-17: show exemplary embodiments of pieces of furniture having pivotable elements which are coupled with the aid of a coupling arrangement.
Figure 16A:
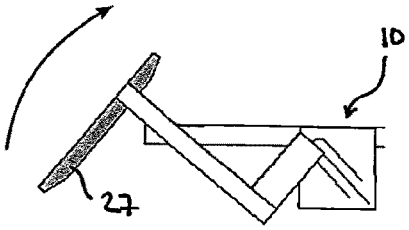
Figure 16B:
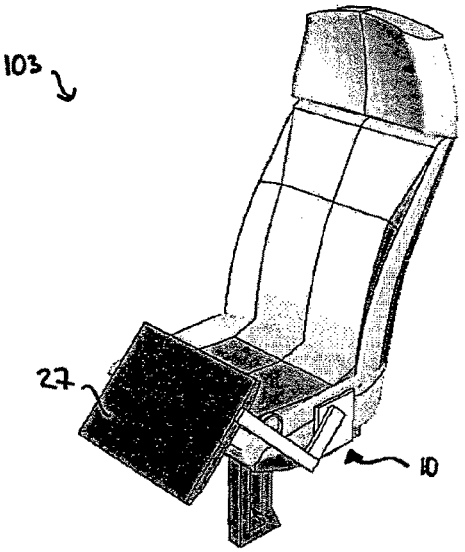
Figure 17:
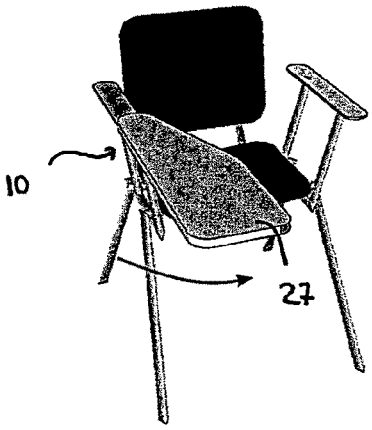

FIGS. 15-17 show examples of pieces of furniture which comprise coupling arrangements as were explained above. FIG. 15 shows a cabinet 102 which comprises a facing element 25 which closes with the aid of the coupling arrangement 10. FIG. 16 shows an airplane or Pullman seat 103 which comprises a swiveling table 27. The swiveling table 27 is pivotable reliably into various positions with the aid of the coupling arrangement 10. In a similar manner to a downwardly pivotable swiveling table arrangement, a corresponding seat can also be equipped with a footrest which is held between two vertical couplings, as is indicated in FIG. 15. A chair 104 having a horizontally pivotable table is illustrated in FIG. 17. In FIGS. 15 and 16, the pivot plane is arranged vertically, while FIG. 17 shows pivoting in the horizontal plane.

Figure 18:
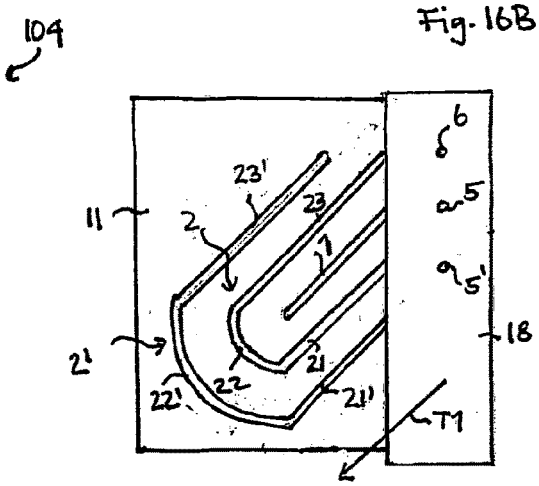
FIG. 18: shows a schematic plan view of a variant of a coupling arrangement having three guide tracks and guide pins.
Figure 19:
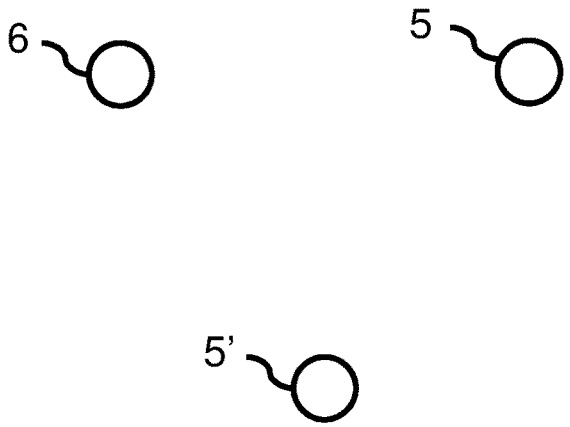
FIG. 19: shows a schematic plan view of an arrangement of guide pins.

FIG. 18 shows a further variant of a guide track geometry. Three guide tracks 1, 2, 2' and guide pins 5, 5', 6 are provided in order to achieve particularly stable guidance and coupling. As in FIG. 9, a first guide track 1 is provided in the first coupling panel 11 as a straight path, a further guide track 2 comprises a straight path 21, a quarter-circle arc 22 and a straight path 23. A third guide track 2' extends parallel to the second guide track 2' and around the latter. Arranged on the second coupling panel 18 are three guide pins 6, 5, 5' which each engage in the associated guide track 1, 2, 2'. This results in three bearing or coupling points on the pins 6, 5, 5', with the result that particularly stable guidance is achieved. The straight sections 1, 21, 21', 23, 23' extend parallel to one another and the arcuate sections 22, 22' are concentric. In some embodiments, the pins 6, 5, 5' form a triangle such that particularly rocking-free and tilt-free translation T1 is enabled. FIG. 19 shows an example arrangement where the pins 6, 5, 5' form a triangle, although other triangular arrangements may be implemented.

Overall, robust guidance is achieved by way of the geometry of the guide tracks and guide pins with respect to one another. Tilting and jamming or sticking is virtually ruled out by the combination for example of round guide pins and round guide tracks in cross section. Overall, the simple geometry, specifically of only straight and only circular sections of the guide tracks, results in scarcely any tilting and jamming or sticking. This results in a particularly reliable coupling and guiding mechanism. Rotation and displacement take place in one plane. Although the rotation and translation in the exemplary embodiments was indicated and explained in the horizontal or a vertical rotation axis, an alternative configuration where the rotation axis is present horizontally is also conceivable. The invention provides a simple possibility of displacing and rotating in particular furniture panels with respect to one another. It is furthermore conceivable to provide more than two guide tracks and guide pins.

REFERENCE SIGNS USED

1, 2, 2' Guide track
3, 4 Insertion recess
5, 6 Guide pin
7 Undercut
8 Closure element
9 Pin attachment
10 Coupling arrangement
11 Coupling panel
12, 13 Tabletop
14 Side leg
15 Wall
16 Storage space
17 Storage shelf
18 Coupling panel
19 Flat cylinder
20 Screw
21, 21' Straight section
22, 22' Arcuate section
23, 23' Straight section
24 Recess
25 Facing element
26 Corner
27 Swiveling table
100 Piece of furniture
101 Coupling arrangement
102 Cabinet
103 Seat
104 Chair
A1, A2 Starting point
D1, D2 Distance
E1, E2 End point
R1 Rotation
R Radius
T1, T2 Translation
X Axis

What is claimed is:

1. A coupling arrangement coupling together two panels that are movable relative to one another, the arrangement comprising:

a first coupling panel in which a first guide track and a second guide track are arranged, the first coupling panel comprising a first edge and an adjoining second edge substantially perpendicular thereto and defining a corner therebetween;

a second coupling panel on which a first guide pin and a second guide pin are arranged;

the first guide pin sized and shaped to be inserted into and movably retained in the first guide track; and the second guide pin sized and shaped to be inserted into and movably retained in the second guide track;

wherein the first guide track includes a straight path positioned along a bisecting line of the corner of the first coupling panel, the first guide track having a starting point and an end point; and wherein the second guide track includes:

a first straight section which is arranged substantially parallel to the first guide track, the first straight section having a first end defining a starting point of the second guide track and a second end;

a circle section having a circle center and first and second ends, the first end of the circle section continuous with the second end of the first straight section; and a second straight section which extends substantially parallel to the first guide track, the second straight section having a first end and a second end defining an end point of the second guide track, the first end of the second straight section continuous with the second end of the circle section;

wherein the circle center of the circle section is located at the end point of the the first guide track, and the circle section is shorter than the first straight section and the second straight section;

wherein the starting point of the first guide track and the starting point of the second guide track are aligned substantially parallel to the first edge of the first coupling panel, and the starting point of the first guide track and the end point of the second guide track are aligned substantially parallel to the second edge of the first coupling panel;

wherein the configuration of the first guide track and the second guide track permits the first guide pin and the second guide pin to be sequentially translated in a fixed manner with respect to one another:

through a first translation where the first guide pin is guided from the starting point of the first guide track to the end point of the first guide track while the second guide pin is guided from the starting point of the second guide track along the first straight section;

through a rotation where the second guide pin runs along the circle section as the first guide pin remains in a fixed position at the end point of the first guide track such that the two panels are rotated 90° with respect to one another; and through a second translation where the first guide pin is guided from the end point of the first guide track to the starting point of the first guide track while the second guide pin is guided along the second straight section to the end point of the second guide track.

2. The coupling arrangement of claim 1, wherein at least one of the first and the second guide tracks comprises an undercut.

3. The coupling arrangement of claim 1, wherein at least one of the first and the second guide tracks has a guide groove with a plurality of steps.

4. The coupling arrangement of claim 1, wherein at least one of the first and second guide tracks comprises an insertion recess adapted to insert the first guide pin or the second guide pin into the at least first or second guide track.

5. The coupling arrangement of claim 4, further comprising a closure element adapted to be inserted into the insertion recess in order to close the insertion recess such that the first or the second guide pin is prevented from slipping out of the at least one guide track.

6. The coupling arrangement of claim 1, wherein the first guide track and the second guide track comprise only straight sections and arcuate sections.

7. The coupling arrangement of claim 1, wherein the first coupling panel is comprised at least partially from a plastics material.

8. The coupling arrangement of claim 1, wherein the first coupling panel comprises a first panel with the first and second guide tracks passing through the first panel thereby forming openings in the first panel; and wherein the first coupling panel comprises a second panel which is a closed panel, the second panel being arranged on the first panel thereby closing the guide tracks in the first panel on one side.

9. The coupling arrangement of claim 1, wherein the coupling arrangement comprises exactly two guide tracks and two guide pins.

10. The coupling arrangement of claim 1, further comprising at least one third guide track and at least one third guide pin.

11. An article of furniture having a first panel and a second panel which are coupled together with the aid of a coupling arrangement, the coupling arrangement comprising:

a first coupling panel in which a first guide track and a second guide track are arranged, the first coupling panel comprising a first edge and an adjoining second edge substantially perpendicular thereto and defining a corner therebetween;

a second coupling panel on which a first guide pin and a second guide pin are arranged;

the first guide pin sized and shaped to be inserted into and movably retained in the first guide track; and the second guide pin sized and shaped to be inserted into and movably retained in the second guide track;

wherein the first guide track includes a straight path positioned along a bisecting line of the corner of the first coupling panel, the first guide track having a starting point and an end point; and wherein the second guide track includes:

a first straight section which is arranged substantially parallel to the first guide track, the first straight section having a first end defining a starting point of the second guide track and a second end;

a circle section having a circle center and first and second ends, the first end of the circle section continuous with the second end of the first straight section; and a second straight section which extends substantially parallel to the first guide track, the second straight section having a first end and a second end defining an end point of the second guide track, the first end of the second straight section continuous with the second end of the circle section;

wherein the circle center of the circle section is located at the end point of the the first guide track, and the circle section is shorter than the first straight section and the second straight section;

wherein the starting point of the first guide track and the starting point of the second guide track are aligned substantially parallel to the first edge of the first coupling panel, and the starting point of the first guide track and the end point of the second guide track are aligned substantially parallel to the second edge of the first coupling panel;

wherein the first and second guide tracks do not bifurcate;

wherein the configuration of the first guide track and the second guide track permits the first guide pin and the second guide pin to be sequentially translated in a fixed manner with respect to one another:

through a first translation where the first guide pin is guided from the starting point of the first guide track to the end point of the first guide track while the second guide pin is guided from the starting point of the second guide track along the first straight section;

through a rotation where the second guide pin runs along the circle section as the first guide pin remains in a fixed position at the end point of the first guide track such that the two panels are rotated 90° with respect to one another; and through a second translation where the first guide pin is guided from the end point of the first guide track to the starting point of the first guide track while the second guide pin is guided along the second straight section to the end point of the second guide track.

12. The piece of furniture of claim 11, wherein the first and the second panel are arranged substantially horizontally or vertically for mutual pivoting.

13. The piece of furniture of claim 11, wherein the article of furniture is a table, a piece of seating furniture, a rack or a cabinet.

* * * * *